United States Patent [19]

Gutjahr et al.

[11] 3,946,659

[45] Mar. 30, 1976

[54] DEVICE FOR POSITIONING OVERLAPPING ENDS OF A LOOPED BAND IN A WORKING AREA OF AN AUTOMATIC PACKAGING MACHINE

[75] Inventors: Paul Gutjahr, Zurich; Hans Lüthi, Egg; René Wasser, Adliswil, all of Switzerland

[73] Assignee: Erapa AG, Zumikon, Switzerland

[22] Filed: Jan. 10, 1974

[21] Appl. No.: 432,288

[30] Foreign Application Priority Data

Jan. 22, 1973 Switzerland ..... 853/73

[52] U.S. Cl. ..... 100/4; 100/26

[51] Int. Cl.[2] ..... G05D 15/00; B65B 13/04

[58] Field of Search ..... 100/4, 26, 33 PB

[56] References Cited

UNITED STATES PATENTS

| | | | |
|---|---|---|---|
| 2,850,963 | 9/1958 | Grebe et al. | 100/4 |
| 3,120,171 | 2/1964 | Hall et al. | 100/26 |
| 3,445,307 | 5/1969 | Balamuth et al. | 100/33 PB |
| 3,636,861 | 1/1971 | Weller | 100/4 |

*Primary Examiner*—Robert W. Jenkins
*Assistant Examiner*—Donald B. Massenberg

[57] ABSTRACT

A device for positioning overlapping ends of a looped band in a working area of an automatic packaging machine. The device includes a first slider on one side of the working area and a second slider on the other side of the working area. A driving mechanism coupled to the slider moves them toward each other up to a predetermined distance corresponding to the width of the band in the working area of the packaging machine.

6 Claims, 9 Drawing Figures

DEVICE FOR POSITIONING OVERLAPPING ENDS OF A LOOPED BAND IN A WORKING AREA OF AN AUTOMATIC PACKAGING MACHINE

BACKGROUND OF THE INVENTION

The invention relates to the field of band wrapping machines, and particularly to a device for fixing the position of the overlapping, mutually binding ends of bands in the locking block of a machine for automatic binding packages by encircling them with band material.

In known machines of this kind, a part of the band material is introduced into an annular channel surrounding the package that is to be bound around by moving an end of the band up to a stop. The free end of the band is then caught and stretched around the package by retracting it from its feed-in end. The band is held tight after reaching its final tension, and then cut-off from the band supply. The overlapping band ends are then connected, for example, by welding.

In order to obtain a durable and strong connection, it is necessary to align the ends of the band laterally before their connection especially when using a plastic band. The ends must be placed precisely one above the other on the working position of the locking or connecting mechanism, such as a welding head.

It is known to provide stationary guiding channels in the locking block to guide the band ends laterally. However, such solid, lateral band guides have the disadvantage that the locked band has to be removed from the guiding channels transversely to the plane of the band. In order to do this, it is necessary that the counterpressure plate be laterally shiftable out of the range of the band. However, it has now been demonstrated that, when welding plastic bands by means of a supersonic apparatus, the counterpressure plate must be precisely parallel to the end surfaces of the welding head in order to obtain a satisfactory welded connection. Practically, such precise alignment cannot be obtained with a mobile counterpressure plate.

A further disadvantage consists in the fact that stationary guiding channels are devised for a certain bandwidth and must be replaced in case of a change in the width of the band. The requirement for additional band guides and their installation each time the band width is changed is troublesome and time consuming.

SUMMARY OF THE INVENTION

It is an object of the invention to provide a positioning device eliminating the disadvantage of known guides. According to the invention, two sliders are provided, movable against each other in a direction parallel to the band ends and transverse to the longitudinal axis of the band. When actuated, the sliders approach the band from both sides, but they stop at a predetermined distance corresponding to the width of the band. In such a manner, the band ends are aligned laterally and placed one upon the other upon the working area of the locking device.

BRIEF DESCRIPTION OF THE DRAWINGS

A preferred embodiment of the invention is illustrated in the following figures.

DESCRIPTION OF THE PREFERRED EMBODIMENTS

Figure 1:
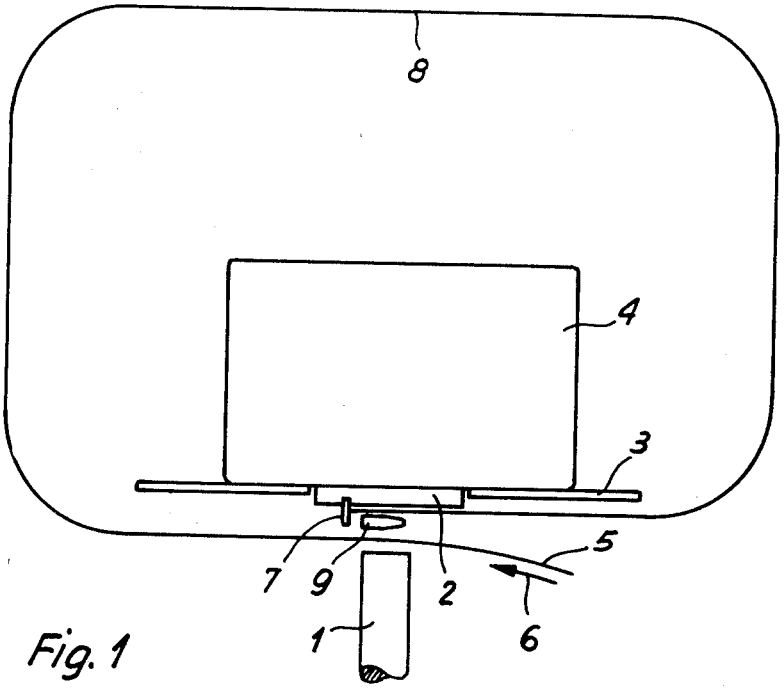
FIG. 1 shows schematically the course of the band encircling the package before the beginning of the binding operation.

FIG. 1 shows, in a simplified illustration, a locking device of a machine for automatically binding packages by encircling them with a plastic band. This locking device comprises a welding head 1 utilizing (for example ultrasonic energy, and a counterpressure plate 2. The package 4 to be bound rests upon the table plate 3. The band 5, which is initially moved in the direction of the arrow 6, is shown introduced up to the stop 7. At the stage of the operation shown in FIG. 1, the band 5 forms a loop 8 which follows an annular channel (not illustrated) surrounding the package. A separating slider 9 facilitates the introduction of the band. As soon as the stage of operation shown in FIG. 1 is reached, the separating slider 9 is retracted from the path of the band 5. Simultaneously, the positioning device is properly located in the working area.

Figure 2:
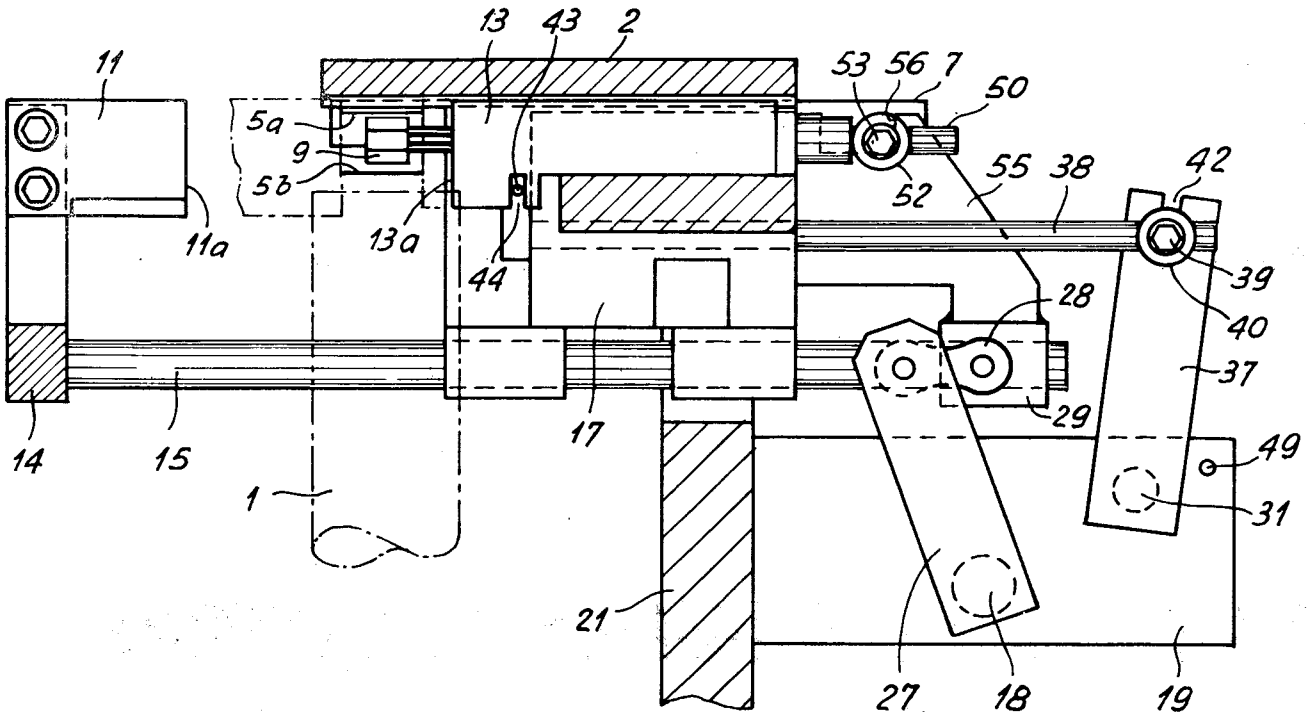
FIG. 2 is a lateral view, partly in cross-section, of the positioning device according to the invention.
Figure 3:
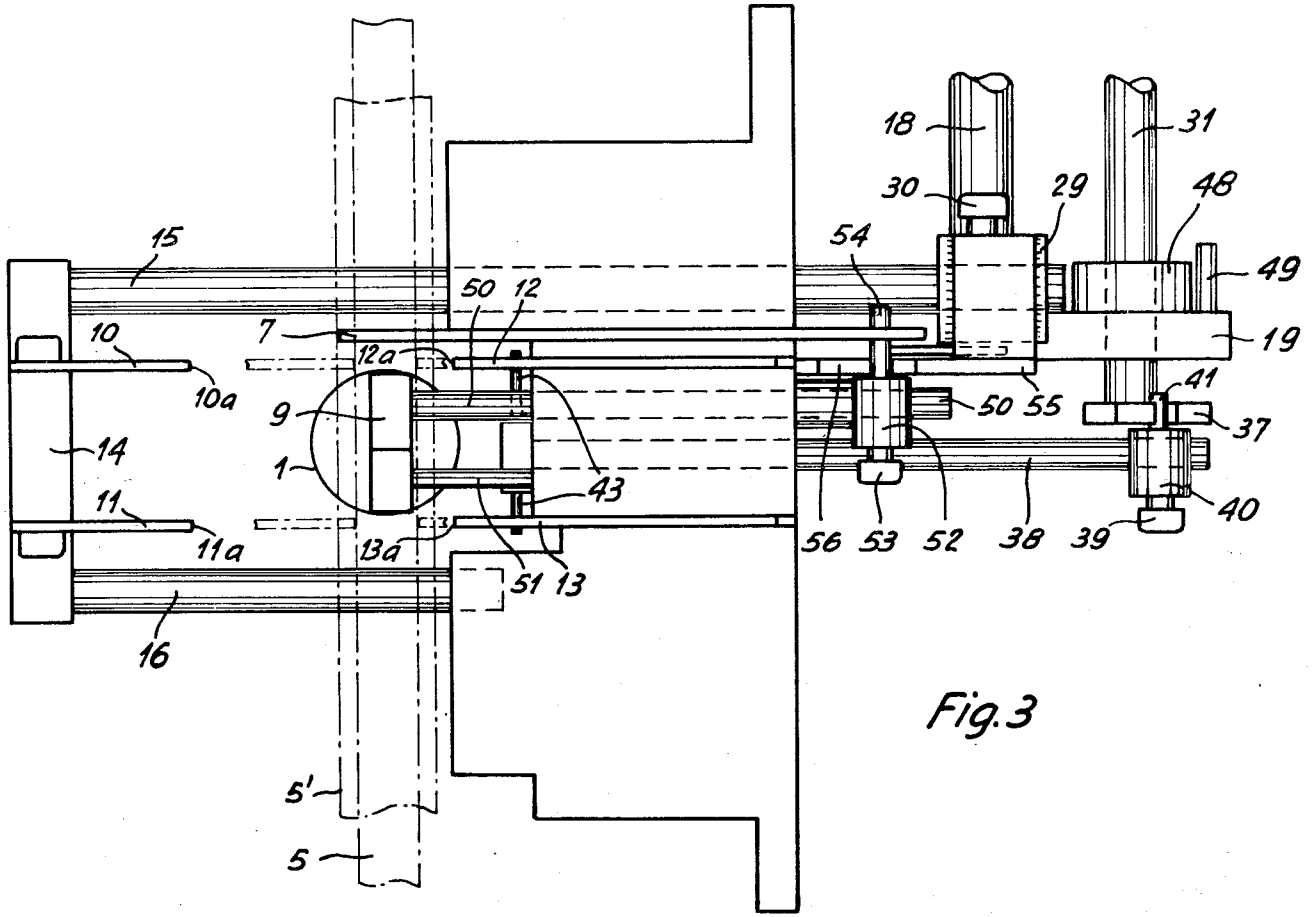
FIG. 3 is a top view of the positioning device according to FIG. 2.

The positioning device is illustrated in FIGS. 2 and 3. For clearness, the counterpressure plate 2 is omitted from FIG. 3. As shown in FIG. 2, the band 5 has a free end **5*a* and a feed-in end 5*b*. As shown in FIG. 3, it is equally possible to apply a wider band 5' instead of the band 5. The approximate limits in the width of admissable bands are shown by bands 5 and 5'**, drawn in dash-dotted lines.

The positioning device includes two sliders movable against each other in a direction parallel to the plane of the band and traverse to the longitudinal axis of the band. Each slider is provided with a pair of parallel centering plates 10, 11 and 12, 13. The pairs of plates 10, 11 and 12, 13 are spaced apart on both sides of the working area of the locking device (that is, on both sides of the welding head 1) and traverse to the overlapped band. One pair of centering plates 10, 11 is connected by a cross-beam 14 with two parallel guiding rods 15, 16 which are longitudinally shiftably supported in a block 17. The other pair of centering plates 12, 13 is directly supported in the block 17 and is also longitudinally shiftable.

When actuated from their illustrated resting position, both sliders are always operated so that they approach from both sides the overlapping band ends **5*a* and 5*b* up to a distance corresponding to the band width. Thus, the band ends 5*a*, 5*b* are aligned in the working position of the locking device by the opposite edges 10*a*, 11*a*, 12*a*, 13*a* of the laterally positioned centering plates 10, 11, 12, 13. The resting position of centering plates 10, 11 are further from the working position of the locking device than the resting position of centering plates 12, 13, so that the locked band can be removed later in the direction toward the centering plates 10, 11** (to the left in FIGS. 2 and 3, laterally from the working position of the locking device).

Beside both sliders of the positioning device, there is the stop 7 and the separating slider 9 in the block 17, supported to be longitudinally shiftable with axes of movement parallel to the separating slider. A driving mechanism, common to all mobile parts 7, 9, 10, 11, 12, 13, actuates them. The driving mechanism is designed so that those mobile parts which have to travel the longest path during operation (centering plates 10, 11) are directly driven, while members traveling a shorter working path are switched-on after a lost motion.

Figure 5:
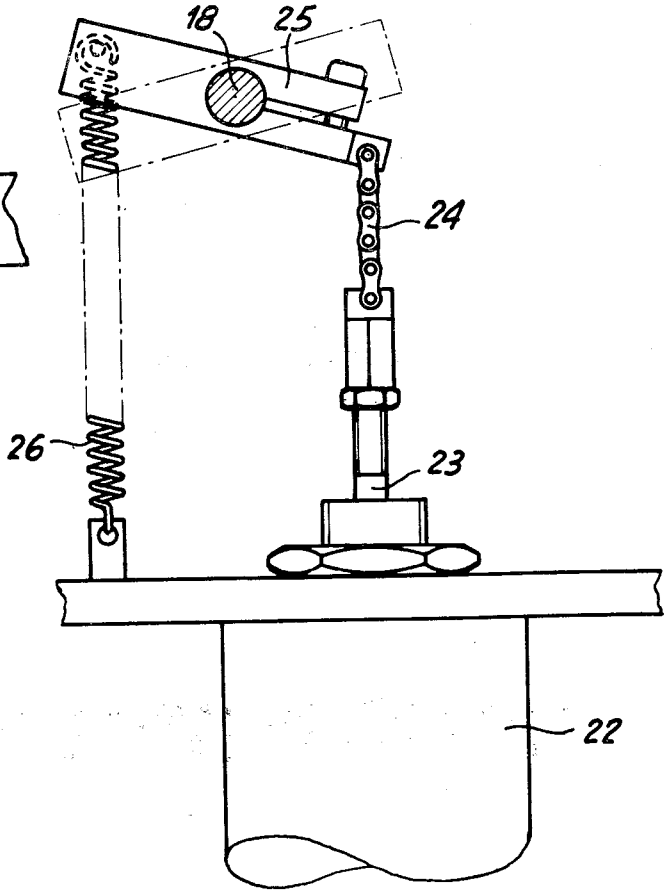
FIG. 5 is a lateral view of the traction magnet utilized in the driving device according to FIG. 4.

The driving mechanism includes a main driveshaft 18 (FIGS. 2, 3, and 4) rotatably supported in two bearing blocks 19, 20. These bearing blocks 19, 20 are attached to a structural body plate 21 connected to the block 17. Power for rotating the main driveshaft 18 is provided by a traction magnet 22 (FIGS. 4 and 5), connected by its axially movable armature rod 23 through a chain-piece 24 with an arm of a double-armed lever 25 clamped rigidly to the main driveshaft 18. A release spring 26 grips the other arm of the lever 25.

A single armed rocking lever 27 (FIG. 2) is seated on one end of the main driveshaft 18 with its free end connected by means of an articulated shackle 28 and a setting ring 29 placed adjustably on the guide rod 15 of the slider. The centering plates 10, 11 are fixed on the guide rod 15 by means of a set screw 30. When the traction magnet 22 is energized, the rocking lever 27 is pivoted over the main driveshaft clockwise as shown in FIG. 2; so that the slider, arranged at the left side of FIG. 2, is moved with the centering plates 10, 11 to the right toward its operating position.

An auxiliary driveshaft 31 drives the slider carrying centering plates 12, 13. The auxiliary driveshaft 31 is placed in parallel with the main driveshaft 18 and also supported rotating in bearing blocks 19, 20. This auxiliary driveshaft 31 is coupled to a follower device having lost motion, so that the auxiliary driveshaft 31 starts to rotate later than the main driveshaft 18 and in an opposite sense of rotation.

The follower device (FIG. 4, 6, 7) consists of a lever 32 having a gaping orifice 33 rigidly clamped to the main driveshaft 18 with a set screw 34 placed on the free end of the lever 32. The set screw 34 penetrates into lever 32 and cooperates with a lever 35. Lever 35 is rigidly clamped to the auxiliary driveshaft 31 and has a laterally placed bolt 36 penetrating into the gaping orifice 33 of the other lever 32. When main driveshaft 8 is turned clockwise from the rest position of the follower device (FIG. 6), the lever 32 moves without having any effect (lost motion) until the leg of the set screw 34 meets the bolt 36 on the other lever 35, whereafter the latter is moved along, and the auxiliary driveshaft 31 is turned counterclockwise.

A rocking lever 37 (FIG. 2 and 3) is positioned on one end of the auxiliary driveshaft 31, and has its free end articulately connected with an adjusting ring 40, placed adjustably on a pushrod 39. A bolt 41 on the adjusting ring 40 penetrates into a longitudinal slot 42 on the free end of the rocker arm 37. A pushrod 38 is longitudinally and slidingly supported in the block 17, and carries on its other end a crossbolt 43 protruding from both sides. Both ends of the crossbolt penetrate into a slot 44 in the centering plates 12, 13, so that these centering plates are carried along with the shifting of the pushrod 38.

The setscrew 34 on the follower lever 32 is adjusted so that, during the transfer of the device into its working position by energizing the traction magnet 22, the more remote slider is first conducted by the centering plates 10, 11 alone in the direction toward its working position. When it is at the same distance from the working position of the locking device as the other slider with the centering plates 12, 13 (which is still in its resting position) both sliders are moved towards each other into their working positions.

Figure 4:
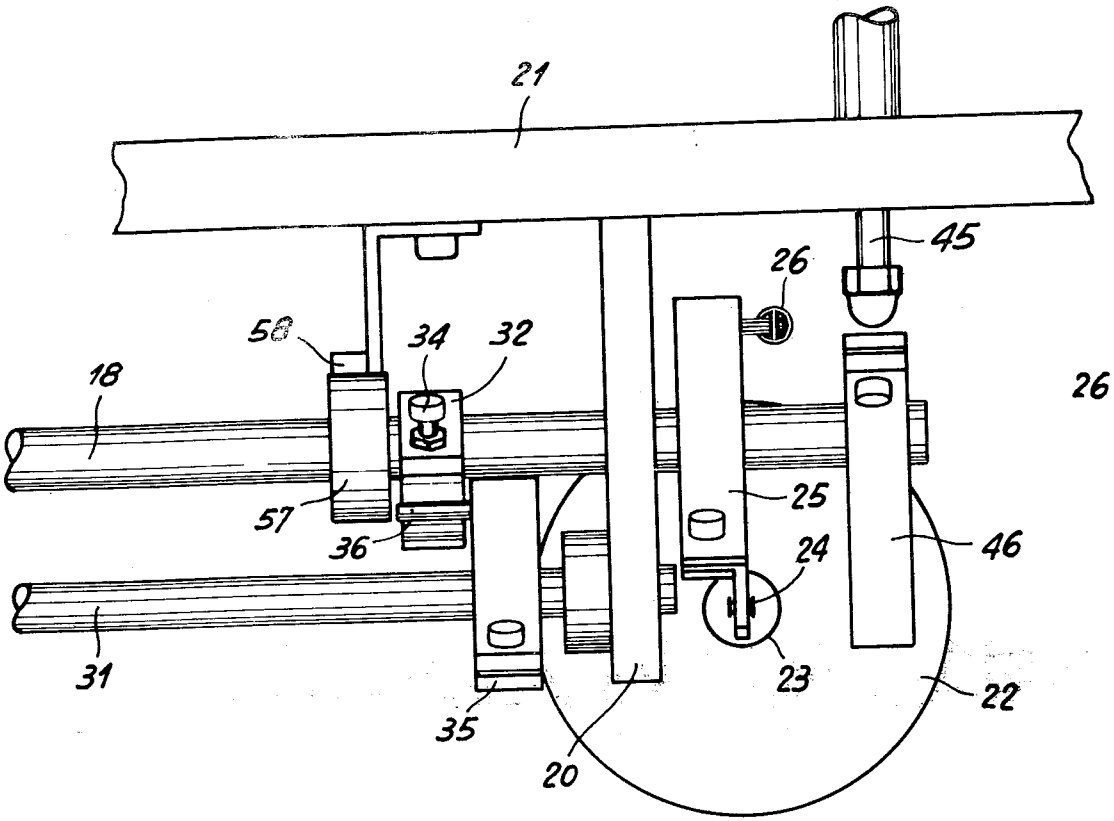
FIG. 4 is a top view of a part of the driving device for the positioning device according to FIGS. 2 and 3.

The movement of both centering sliders is limited by stops in both directions. The working positions of the centering plates 10, 11, 12, 13 are determined by an adjustable stop screw 45 which can be fixed by means of a lock nut 46 with a cooperating stop lever 47, rigidly clamped to the main driveshaft 18 (FIG. 4, 8). By turning the stop screw 45, it is possible to adjust the distance between centering plates 10, 11 and centering plates 12, 13 when they are in their working position (in FIG. 2 and 3 indicated in dash-dotted lines) to the width of the applied band 5.

Figure 6:
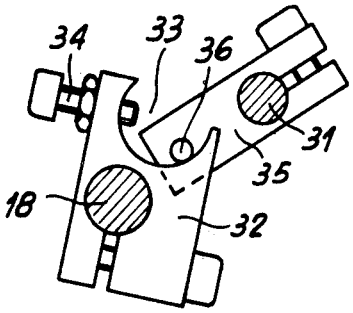
FIGS. 6 and 7 are lateral views of the follower of the driving device in an initial and a working position.
Figure 9:
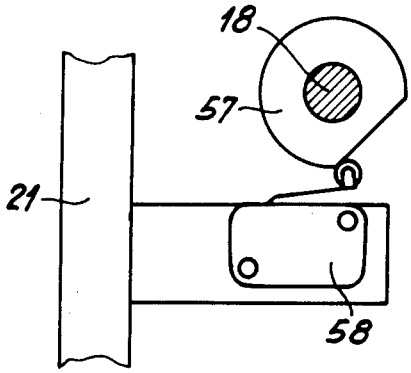
FIG. 9 is a side view of a switching device coupled to the driving mechanism.
Figure 7:
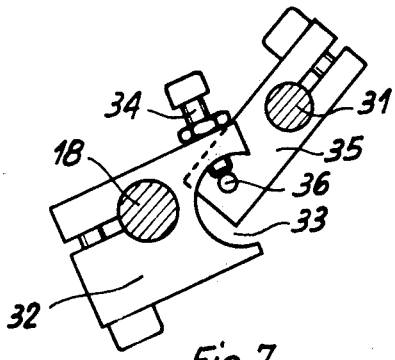
Figure 8:
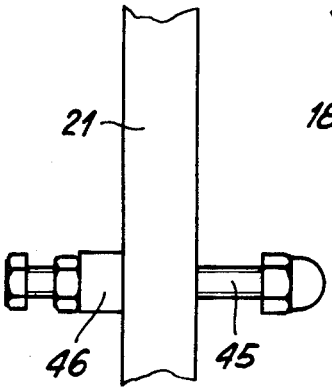
FIG. 8 is a lateral view of a stopping device for the setting of the positioning device for the particular width of the applied band.
Figure 8:
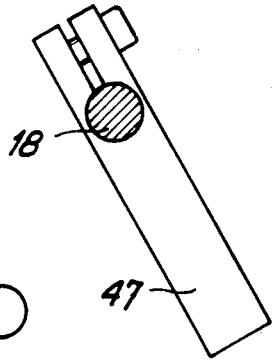

The resting position of the centering plates 12, 13 is determined by the stop of a cam plate 48 on the auxiliary driveshaft 31 and a bolt 49 on the bearing block 19 (FIGS. 2, 3). The resting position of the centering plates 10, 11 is determined by the stop of the projection 32a of follower lever 32 on the bolt 36 of the other follower lever 35 (FIG. 6).

The stop slider 7 and the separating slider 9 are also coupled to the described driving mechanism and are simultaneously removed from the path of the band 5 when the positioning device is transferred into working position. The separating slider 9 has two longitudinally sliding guide rods 50, 51 supported in bearings in the block 17. An adjusting ring 52 is fixed with set-screw 53 on the free end of the guide rod 50. The set-screw 53 penetrates with a coupling bolt 54 into an orifice in the stop slider 7 whereby both sliders 7 and 9 are mutually coupled. A shifting plate 55 serves for driving them with a setting ring 29 rigidly connected to the guide rod 15 of the centering device, and having an incision 56 with the coupling bolt 54 penetrating into it. The incision 56 is in the direction of movement of the shifting plate 55 and is longer than the diameter of the coupling bolt 54, so that there is lost motion in the coupling connection between these two parts. This provides for the different working paths which are to be absolved by the centering plates 10, 11 on one side and the stop slider 7 with the separating slider 9 on the other.

A cam plate 57 sits further on the main driveshaft 18 for actuating an electric switch 58 (FIG. 4, 9) attached to the base plate 21, the function of which will be explained further on. This switch 58 is always actuated when the described device reaches its resting position.

The positioning device is set into operation as soon as the band 5 is introduced in the manner represented in FIG. 1 into the locking block, i.e., before the retraction of the band takes place. When the positioning device has reached its working position, the stop slider 7 and the separating slider 9 are placed outside the path of the band 5.

For welding both ends of the band 5*a* and 5*b*, the welding head 1 is lifted, whereby the band ends between the welding head 1 and the counterpressing plate 2 are compressed. The centering device remains in working position until the welding process ends and the welding head 1 is lowered again. The traction magnet 22 is then switched-off, so that the driving mechanism tends to move backward under the action of the release spring 26 into its resting position. This retreat is, however, halted by the fact that the stop slider 7 hits laterally the locked band 5. The band 5, passing beneath and through the counterpressing plate 2, is liberated from it by shifting package 4 upon the table plate 3 in order that the package 4 may be lifted from the table plate 3. Only then can the stop slider 7 and all mobile parts return to their resting position. The switch 58 is also actuated in this moment and releases the introduction of a new piece of band into the locking block.

From the foregoing, it can be readily realized that this invention can assume various embodiments. Thus, it is to be understood that the invention is not limited to the specific embodiments described herein, but is to be limited only the appended claims.

What is claimed is:

1. A device for positioning overlapping ends of a band in a working area of a machine comprising:

a first slider moveable on one side of said working area;

a second slider moveable on the other side of said working area;

a driving means coupled to said sliders for moving said sliders towards each other up to a predetermined distance corresponding to the width of said band;

a band-end stop lever positionable in said working area;

and a separating slider positionable in said working area, said band-end stop lever and said separating slider being coupled to said driving means for movement transversely of said working area.

2. The device as claimed in claim 1, wherein each of said sliders includes a pair of vertically oriented parallel centering plates, one of said pairs being positioned on one side of said working area, and the other pair being spaced apart from said one pair and positioned on the other side of said working area, the edges of apposing pairs of centering plates facing each other for aligning said ends of a band when said sliders move towards each other.

3. The device as claimed in claim 1, wherein said adjusting means includes a rotatable stop lever cooperating with a stationary adjustable stop.

4. The device as claimed in claim 1, wherein said driving means includes adjusting means, whereby said predetermined area can be adjusted to accommodate bands of different widths.

5. A device for positioning overlapping ends of a band in a working area of a machine comprising:

a first slider moveable on one side of said working area;

a second slider moveable on the other side of said working area; and a driving means coupled to said sliders for moving said sliders towards each other up to a predetermined distance corresponding to the width of said band; and wherein said first slider is moveable a further distance from said working area than said second slider, whereby said band can be removed from said working area in a direction toward said first slider.

6. The device as claimed in claim 5, wherein said driving means includes a follower means coupling said first slider to said second slider, said follower means including a lost motion means, whereby said first slider is moved said further distance by said driving means until both said sliders are equidistant from said work area whereupon both said sliders are moved toward said work area.

* * * * *